US007836656B2

(12) United States Patent
Crosbie

(10) Patent No.: US 7,836,656 B2
(45) Date of Patent: Nov. 23, 2010

(54) TOWER MODULE, SYSTEM AND METHOD

(76) Inventor: Patrick J. Crosbie, 195 Pyle St., Oradell, NJ (US) 07964

( * ) Notice: Subject to any disclaimer, the term of this patent is extended or adjusted under 35 U.S.C. 154(b) by 249 days.

(21) Appl. No.: 11/809,447

(22) Filed: Jun. 1, 2007

(65) Prior Publication Data

US 2008/0295424 A1 Dec. 4, 2008

(51) Int. Cl.
*E04H 12/00* (2006.01)

(52) U.S. Cl. ..... 52/651.01; 52/650.1; 52/655.1

(58) Field of Classification Search ..... 52/236.3, 52/236.7, 236.9, 253, 582.2, 585.1, 589.1, 52/590.2, 650.1, 651.01, 651.07, 651.1, 655.1, 52/661, 838, 844, 848; 211/191, 192, 194; 403/7, 353; 411/999
See application file for complete search history.

(56) References Cited

U.S. PATENT DOCUMENTS 2,936,051 A * 5/1960 Martin ..... 52/694
3,295,874 A * 1/1967 Allen ..... 403/217
3,912,087 A * 10/1975 Zeischegg ..... 211/194
4,330,970 A * 5/1982 Bonink ..... 52/125.4
4,484,831 A * 11/1984 Hanson et al. ..... 403/7
5,791,502 A * 8/1998 Bietz et al. ..... 211/192
5,980,160 A * 11/1999 Vanderklaauw ..... 405/230
6,425,712 B1 * 7/2002 Vanderklaauw ..... 405/230
6,814,184 B1 11/2004 Blinn, Jr.
2005/0111912 A1 * 5/2005 Brain et al. ..... 403/353

* cited by examiner

*Primary Examiner*—Brian E Glessner
*Assistant Examiner*—Patrick Maestri
(74) *Attorney, Agent, or Firm*—Tutungian & Bitetto, P.C.

(57) ABSTRACT

A tower module, tower module structures and related methods are provided for use in construction support structures. The tower module includes vertical support members, and horizontal members rigidly attached between the vertical members to provide a box-like structure. The box-like structure has a top end portion and a bottom end portion. The top end portion includes a first portion of a connection interface, and the bottom end portion includes a second portion of a connecting interface. The top portion of a first tower module is adapted to receive and connect to the bottom portion of a second tower module for forming a column.

33 Claims, 12 Drawing Sheets

Detail 1

Detail 2

TOWER MODULE, SYSTEM AND METHOD

BACKGROUND

1. Technical Field

The present invention relates to construction structures and more particularly to temporary support structures for erecting and repairing buildings and roadways.

2. Description of the Related Art

In the temporary hoist industry, the main scope of work is to provide vertical transportation for workers and material while the building is being constructed or renovated. This mechanism will generally stay in place until the building's permanent interior elevators have been commissioned or refurbished. There are different styles of installation. In some cases, the hoist is set close to the structure where the personnel and material are dispatched directly at the slab edge. In other cases, the hoist is set away from the structure where a complimentary structure must be introduced to bridge the gap between the hoist and the building.

The complementary structure has been referred to with many different terms in the industry. These terms include runback structures, four-pole structures, hoist bridges common platforms, hoist runways and landing platforms. All of these terms are essentially related to the same function.

Referring to FIG. 1, a schematic diagram shows a complementary structure 10 disposed between a building 12 and a hoist 14. The purpose of the complementary structure 10 includes providing a bridge between the building 12 and the hoist, accommodating setbacks for upper floors of the building, and providing a common landing to permit multiple hoist units to serve the building 12 throughout a single entrance.

Conventional, complementary structures require multiple additional braces (angled braces and/or cross-supports) to sustain a main support column at each corner of the platform. These conventional complementary structures require splice plates and bolts to create a moment connection at any given vertical joint in the support structure. In addition, temporary braces are often employed for the sole purpose of creating a support position for horizontal planking to form a platform. The temporary braces add to the complexity of the structure.

All known conventional systems require numerous nuts and bolts to connect horizontal platform members to vertical supports. These systems use small parts, nuts and bolts that can create a hazard to people and property below the structure. These parts can come loose, or be dropped and cause significant damage and injury.

SUMMARY

A tower module, tower module structures and related methods are provided for use in construction support structures. The tower module includes vertical support members, and horizontal members rigidly attached between the vertical members to provide a, box-like structure. The box-like structure has a top end portion and a bottom end portion. The top end portion includes a first portion of a connection interface, and the bottom end portion includes a second portion of a connection interface. The top portion of a first tower module is adapted to receive and connect to the bottom portion of a second tower module for forming a column.

A tower module structure for use in construction support structures includes at least one tower module column. The tower module column includes a plurality of stacked tower modules. The tower modules each include vertical support members and horizontal members rigidly attached between the vertical members to provide a box-like structure. The box-like structure has a top end portion and a bottom end portion. The top end portion includes a first portion of a connection interface and the bottom end portion includes a second portion of a connecting interface such that the top portion of a first tower module is adapted to receive and connect to the bottom portion of a second tower module for forming a column.

A method for assembling a tower module column, includes providing a plurality of tower modules having vertical support members, horizontal members rigidly attached between the vertical members to provide a box-like structure, the box-like structure having a top end portion and a bottom end portion, the top end portion including a first portion of a connection interface and the bottom end portion including a second portion of a connecting interface such that the top portion of a first tower module is adapted to receive and connect to the bottom portion of a second tower module, stacking the tower modules by engaging the top end portion of a first tower module with a bottom end portion of a second tower module in accordance with an alignment feature and securing the top end portion to the bottom end portion using built-in fasteners to form a structural column.

These and other features and advantages will become apparent from the following detailed description of illustrative embodiments thereof, which is to be read in connection with the accompanying drawings.

BRIEF DESCRIPTION OF DRAWINGS

The disclosure will provide details in the following description of preferred embodiments with reference to the following figures wherein.

DETAILED DESCRIPTION OF PREFERRED EMBODIMENTS

The present embodiments include a tower module, tower module structures and methods for employing the same. The tower module includes a portable structure. In one embodiment, the tower module is box-shaped and includes interface structures for stacking the tower module with other tower modules. The tower modules are stacked and secured using permanently mounted (built-in) fastening devices. The tower modules can be lifted by hand or by crane to stack the modules to form a tower module column.

The tower module column forms a stable column without cross-bracing. In one embodiment, the column may provide approximately 30 feet or more unsupported. Greater or less unsupported lengths are also contemplated. The tower module column includes a ladder-like side appearance so that planking may be inserted horizontally through the tower module column or tower module structure. A tower module column may be connected to a structure or another tower module column using a beam that is adapted with a quick-connecting vertical connection. This connection can be locked with a securing mechanism (e.g., a keyed shaft or other device).

With several tower module columns connected, a free-standing stable support structure or complementary structure may be formed. The tower module structure may be employed as a complementary structure between a hoist and a building or simply as a scaffolding structure. Such structures are quick and relatively easy to assemble, provide greater and more stable support, are transported with ease due to their compact size and provide safety from falling parts.

Embodiments of the present invention will be described in terms of temporary construction structures; however, the present principles may be applicable for use in permanent structures or in assembling temporary building walls, etc.

Figure 2:
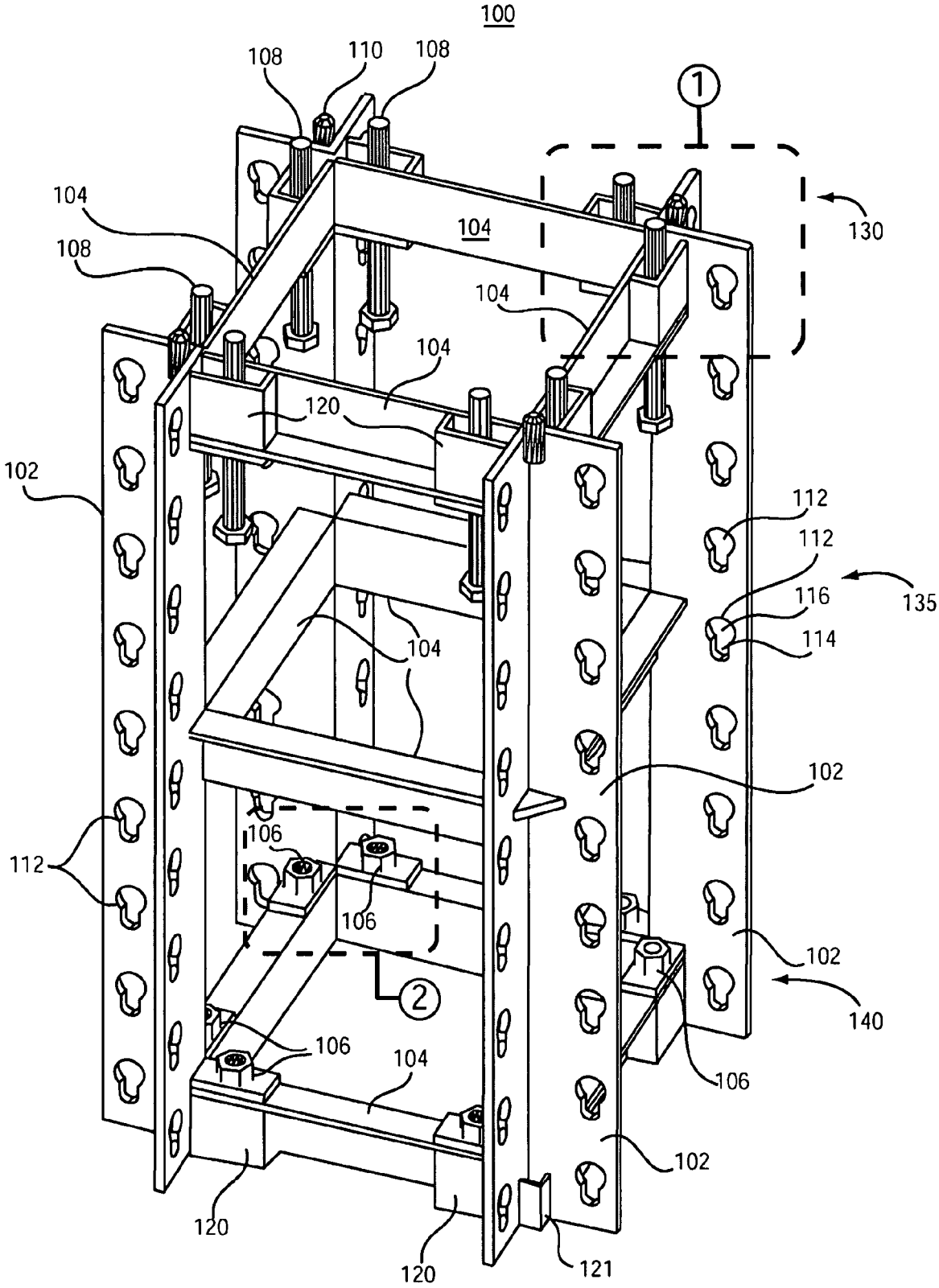
FIG. 2 is a perspective view of a tower module in accordance with an illustrative embodiment.

Referring now to the drawings in which like numerals represent the same or similar elements and initially to FIG. 2, a perspective view of a tower module 100 is shown in accordance with an illustrative embodiment. Tower module 100 includes four vertical support members 102. Different numbers of sides (three, five, etc.) or support members are also contemplated. Each support member 102 preferably includes an "L" shaped column although other shaped columns, such as a box shape a circular tube, etc. may be employed. Vertical support 102 may be modified or enhanced to increase their performance by including supports 118 or other attached structures, as needed. Tower module 100 is preferably as light as possible to permit manual handling of the module 100. For example, module 100 may be 150 pounds or less depending on the design and material selection.

In a preferred embodiment, the support members 102 are formed from steel; however other material may also be employed. Other materials may include, e.g., aluminum, plastics, or other engineered materials that meet the support load requirements and the weight requirements in accordance with the application. Vertical supports 102 are configured with a plurality of openings 112. These openings 112 include a first portion 116 configured to receive a rivet head or similar structure connected to a beam (not shown), and a second portion 114 configured to receive the stem of the rivet and secure from pullout against the head of the rivet. This will be described in greater detail below.

Vertical support members 102 are welded or otherwise rigidly attached to horizontal members 104. Horizontal members 104 are preferably welded or otherwise rigidly attached between adjacent vertical supports 102. Horizontal members 104 form the "rungs of the ladder" for the tower module column, and may be provided in two or more tiers. FIG. 2 shows three tiers of horizontal member 104. A top tier 130 includes slidably coupled bolts 108 (built-in bolts). Bolts 108 are configured to be permanently but slidably mounted with horizontal members 104 of the top tier 130. In the embodiment shown, a box 120 is formed to assist in guiding and supporting the bolts 108. Bolts 108 are configured to threadedly engage nut plates 106 of a second tower module (not shown) that can be stacked on tower module 100. Bolts 108 cannot fall out of box 120 and are retained therein to prevent any bolts 108 from falling during installation or during use.

A lower tier 140 includes nut plates 106. Nut plates 106 are attached to horizontal members 104 of the lower tier 140 and correspond to the positions of bolts 108. Although nut plates 106 are illustratively shown, portions of the horizontal members 104 may be adapted to receive the bolts 108. During stacking of tower modules 100, guide pins 110 of the top tier 130 are employed to locate and align positions between bolts 108 and nut plates 106. Guide pins 110 fit into the angle (or respective position in other designs) of vertical supports 102. An angled plate feature 121 may be employed to receive guide pins 110. In addition, features 121 also provide strength to the L-shape of the vertical members 102. In this way, visual and mechanical alignment of tower modules 100 is performed to ease assembly. Once stacked, bolts 108 are threaded into nut plates 106 to secure the two stacked tower modules (100). Other quick connect schemes are also contemplated, e.g., clamps, latches, etc.

A middle tier 135 includes four horizontal members 104. Depending on the size of the tower module 100, no middle tier 135 or a greater number of middle tiers 135 may be employed.

Conventional systems require multiple additional braces to sustain main support columns at any given corner of a platform structure. In accordance with the present principles, tower modules 100 provide a self-contained tower, at any given corner, which can free-span over a long distance, for example, 30' or more between tie-backs without any additional bracing. In addition, conventional systems require multiple splice plates and bolts in an effort to create a moment connection at any given vertical joint. In stark contrast, a tower module configuration in accordance with one embodiment employs only four bolts per joint to achieve a moment connection. In another embodiment, eight bolts are employed. Numerous nuts and bolts are not needed to connect horizontal platform members 104 to vertical supports 102. In addition, fall hazards suffered by conventional systems are relieved in accordance with built-in flip-up connecting bolts 108 which are never removed from the tower module 100.

Figure 3:
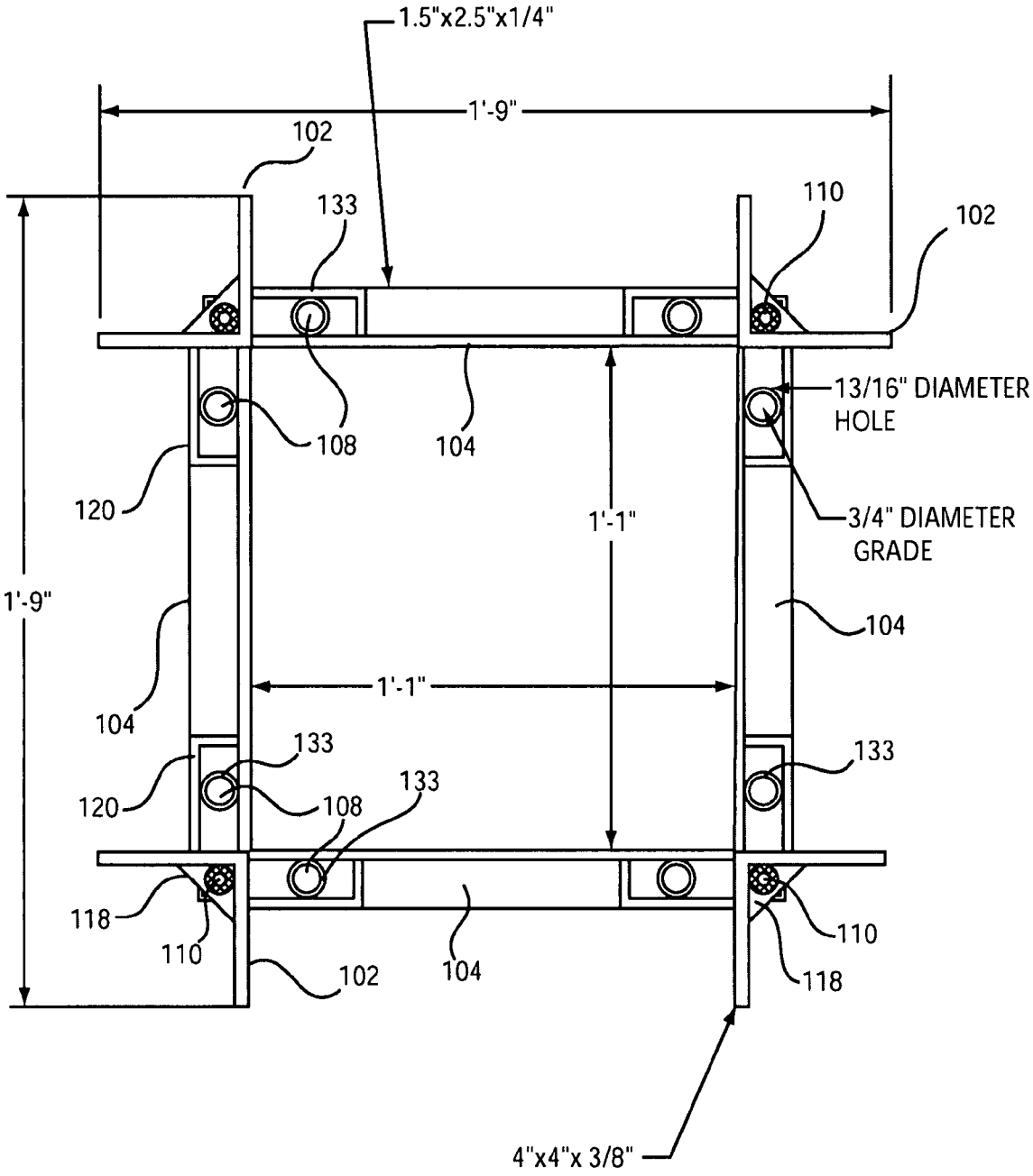
FIG. 3 is a top view of the tower module shown in FIG. 2.

Referring to FIG. 3, a top view of the tower module 100 is illustratively depicted with illustrative dimensions. It should be understood that the dimensions provided are for illustrative purposes only. The dimensions should not be construed as limiting. Overall dimensions of tower module 100 includes 1'9" per side, and the internal dimensions of tower module 100 form a square between horizontal members 104 of 1'1" per side. In accordance with the illustrative embodiment, horizontal members 104 are 1.5"×2.5"×¼ steel members and the vertical supports 102 are 4"×4"×⅜". Bolts 108 are ¾" diameter in 13/16" holes 133. Other dimensions and configurations are also contemplated.

Figure 4:
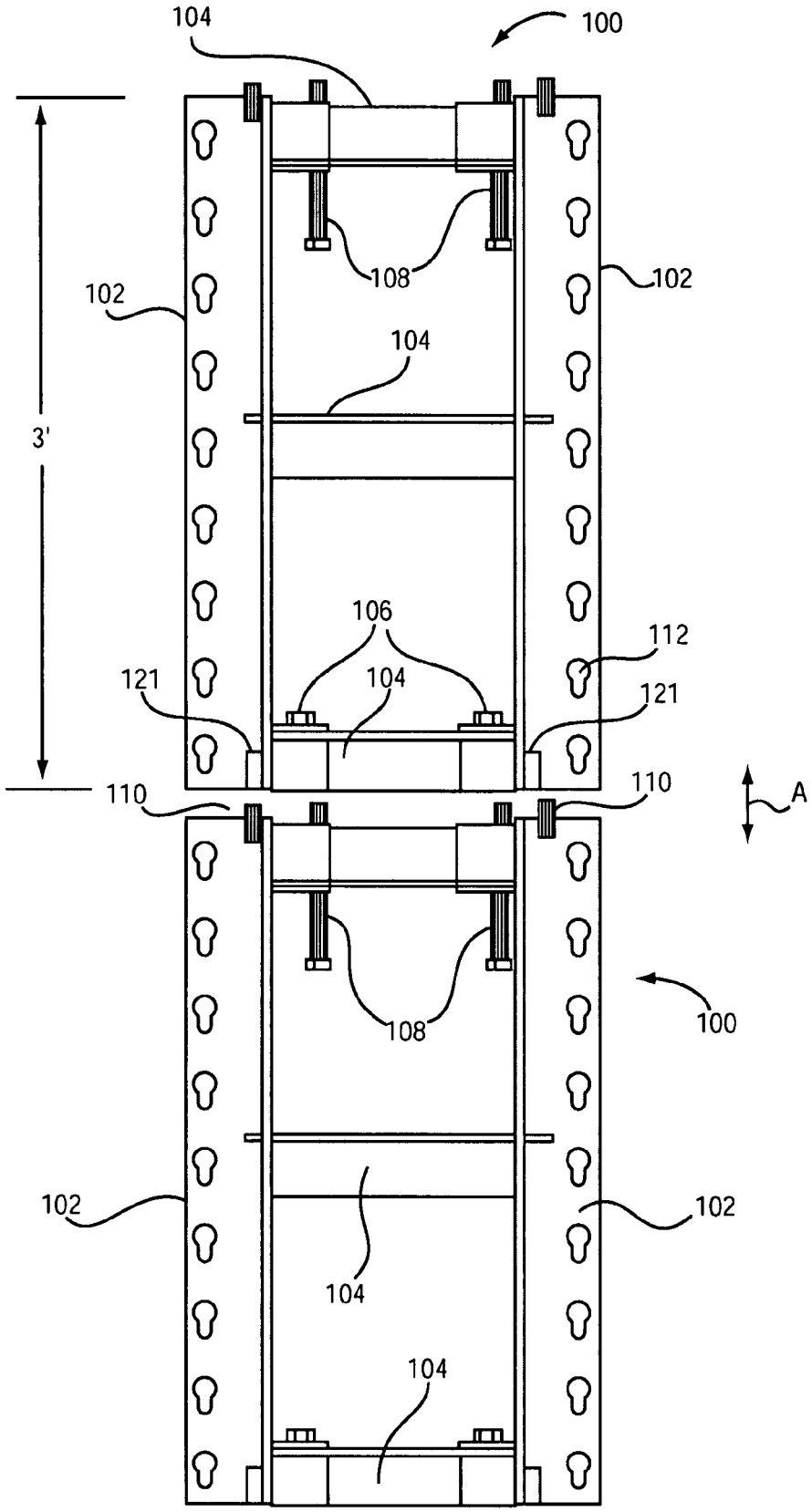
FIG. 4 is a side view showing stacking and securing of tower modules in accordance with one embodiment.

Referring to FIG. 4, a side view shows the stacking of two tower modules 100 in accordance with the present principles. Guide pins 110 are employed along with the visual alignment of vertical supports 102 to line up the two tower modules 100. The tower modules 100 are stacked by placing one tower module on top of the other and moving the tower modules 100 together along direction "A". Once in place, bolts 108 are employed to bolt the two tower modules 100 using the nut plates 106.

Figure 1:
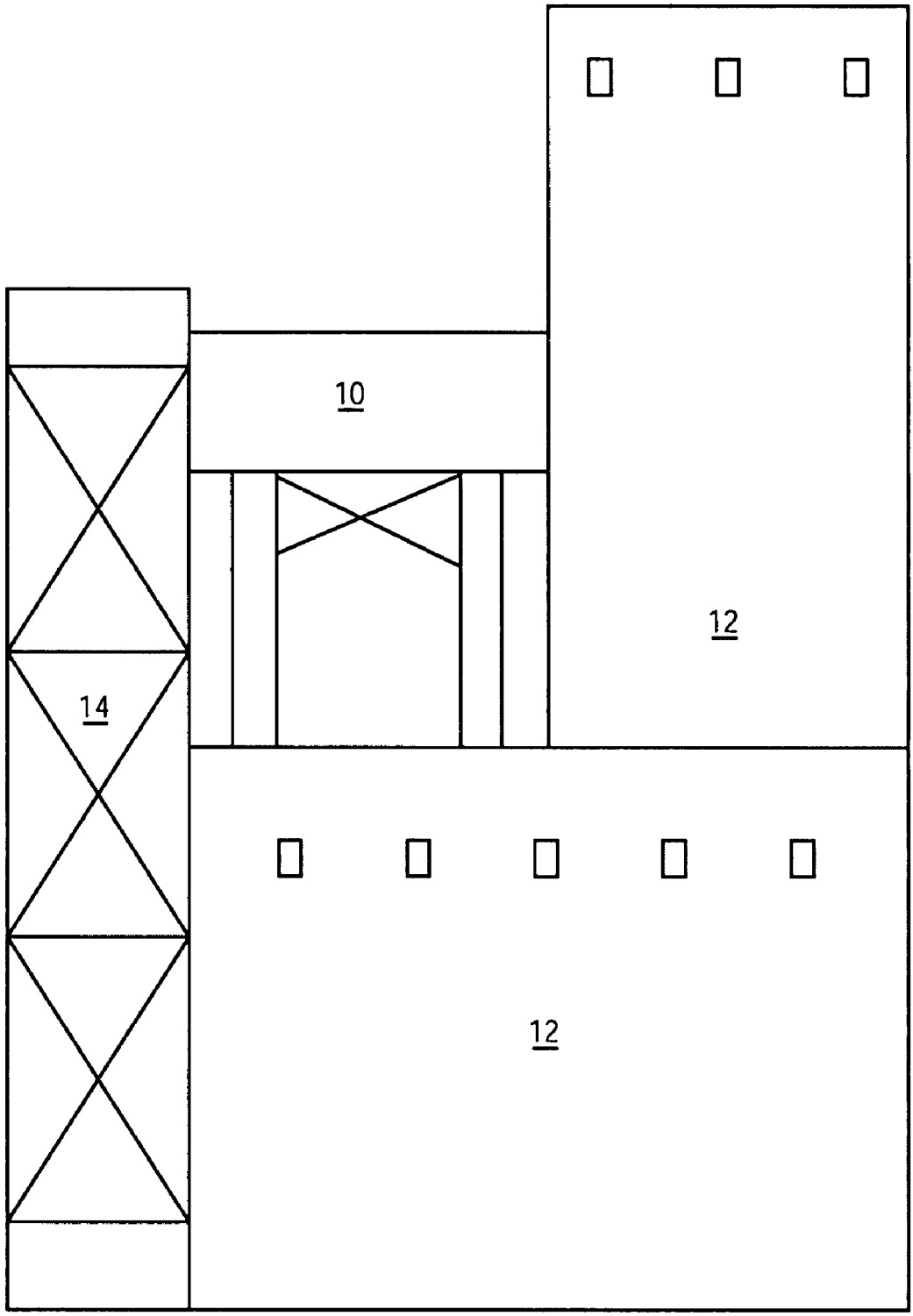
FIG. 1 (Prior Art)
FIG. 1 is a prior art depiction of a complementary structure in accordance with the prior art.
Figure 5:
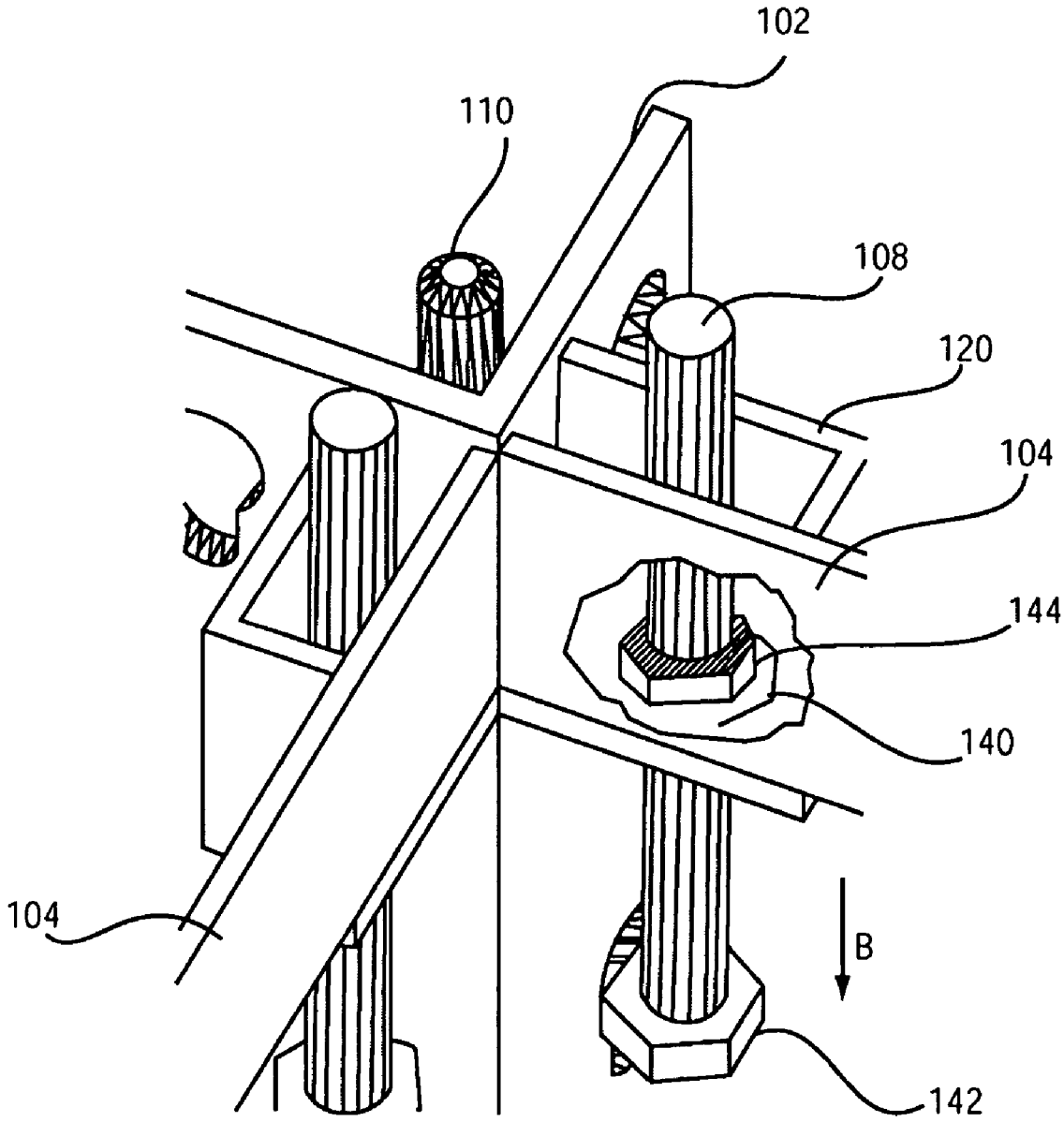
FIG. 5 is a perspective view of Detail 1 of FIG. 2 showing built-in bolts in accordance with one illustrative embodiment.

Referring to FIG. 5, a detail 1 from FIG. 1 is shown rotated and includes a cutaway to horizontal member 104 to view inside box 120. Bolt 108 includes a securing mechanism 144 which prevents bolt 108 from falling out in direction "B". Securing mechanism 144 provides a larger size than a bolt hole (not shown) to ensure engagement with a surface 140 to prevent the bolt 108 from getting free. Securing mechanism 144 may include a nut, a cotter pin, a raised portion of the bolt, protrusions on the bolt, a raised diameter or any other suitable mechanism. Bolt 108 may be permitted to slide along its axis and can rotate about its axis through surface 140. Bolt head 142 prevents bolt 108 from moving through surface 140 in the direction opposite to direction "B". Securing mechanism 144 is positioned on bolt 108 to permit the stacking assembly between tower modules 100 and to permit threading and securing of the bolt 108 to an adjacent tower module 100 during use. Other fastening devices may also be employed instead of or in addition to bolt/nut plate assemblies.

Figure 6:
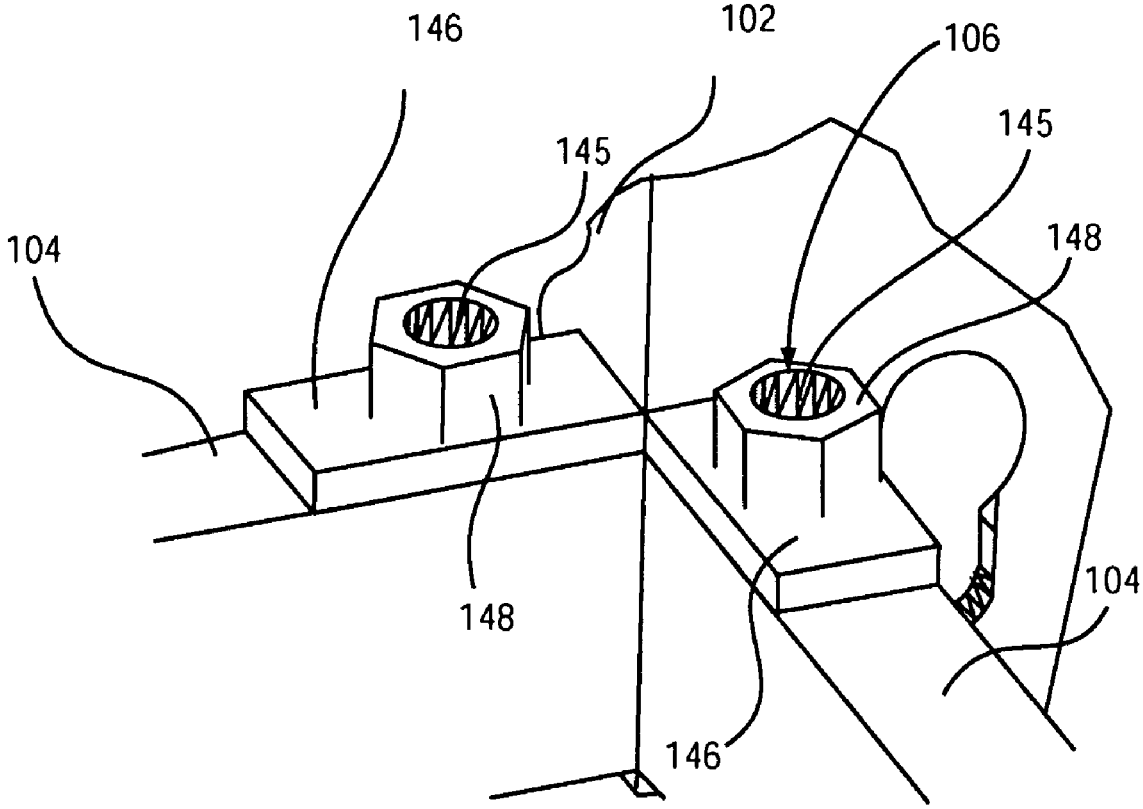
FIG. 6 is a perspective view of Detail 2 of FIG. 2 showing nut plates in accordance with one illustrative embodiment.

Referring to FIG. 6, a detail 2 from FIG. 1 is shown rotated. Nut plates 106 may include a nut 148 welded to a plate 146, and secured to horizontal members 104 at locations corresponding to bolts 108. A hole 145 through nut plate 106 permits access by bolts 108 from below.

Figure 7:
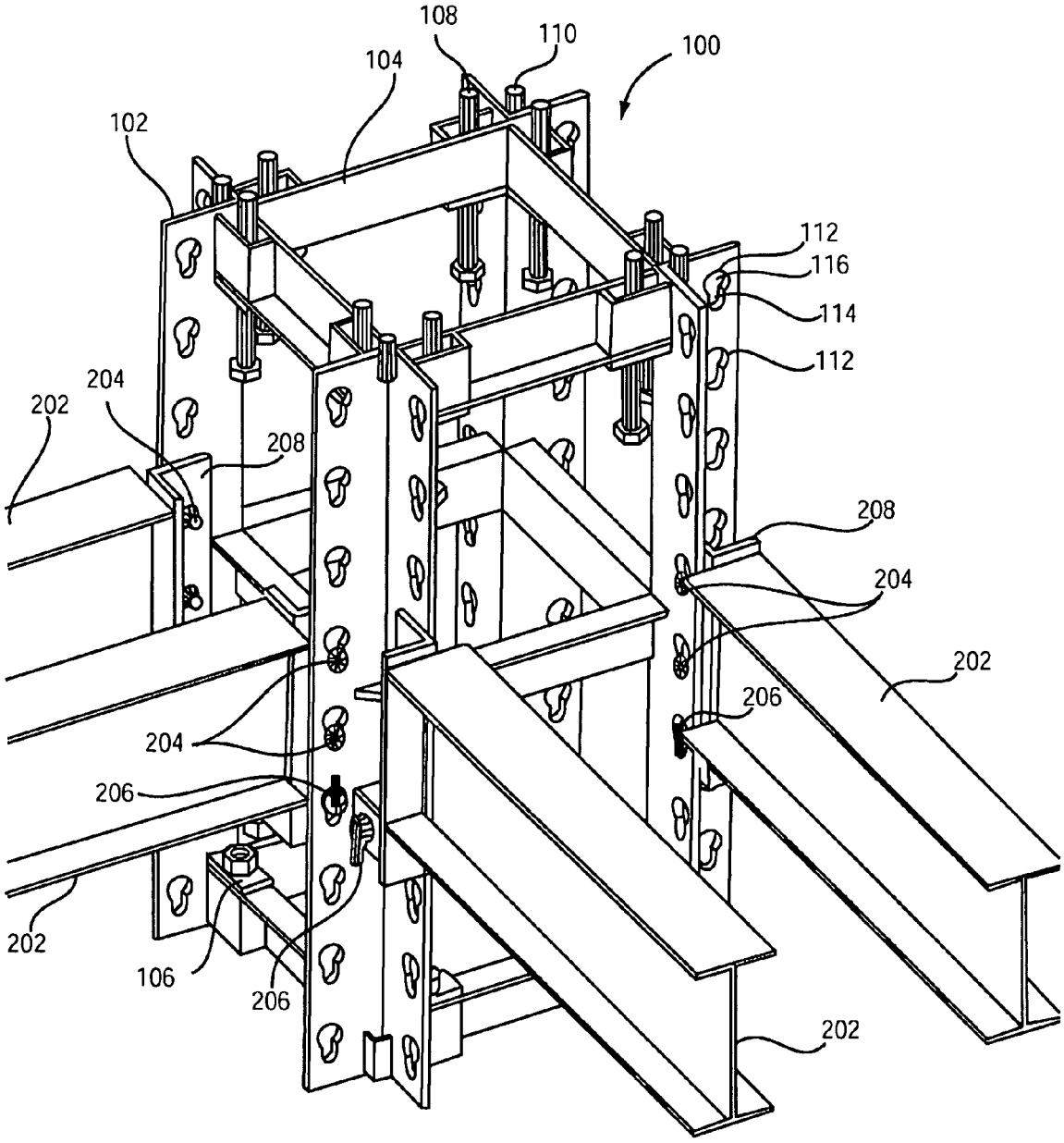
FIG. 7 is a perspective view showing connecting and securing of beams to a tower module in accordance with one embodiment.

Referring to FIG. 7, a tower module 100 is shown connected with support beams 202 in accordance with the present principles. Beams 202 may be of the W8×10 type, although other beams types may be employed. Support beams 202 detachably connect to module 100 using studs or rivets 204. Studs 204 include heads that pass into the first portion 116 of openings 112 and slip/slide down into the second portion 114 or openings 112. While gravity assists in this assembly, a retaining pin 206 is employed to lock the beams 202 in place and prevent the undesirable release of beams 202 from their secured position.

Beams 202 may include I beams or other shaped beams, and include a flange 208 welded or otherwise attached to the end portion of the beam to provide studs 204 with a predetermined spacing corresponding with the pattern of holes 112 along vertical support 102. During assembly, studs 204 are positioned into openings 112 and permitted to drop into a secured position. Next, retaining pins 206 are engaged to prevent the disassembly of beams 202 from tower module 100.

The illustrative depiction shows two beams 202 employed on each side of tower module 100. However, one beam 202 per side may be employed. In addition, beams 202 may be placed in any combination (one or two on all four sides, three sides, one side, etc.). This contributes to the flexibility of construction not present in conventional systems.

A continuous keyhole arrangement (openings 112) is employed on every elevation to receive platform beams 202 with integral attachment pins or studs 204 which lock into place without any nuts or bolts.

Figure 8:
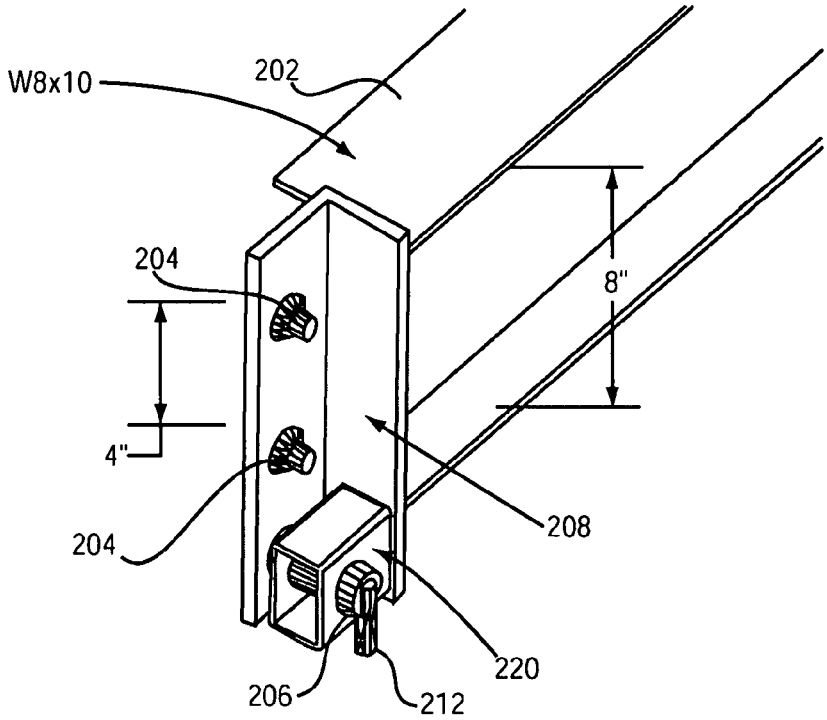
FIG. 8 is a perspective view showing an end portion of a beam showing studs and a retaining pin in accordance with one embodiment.
Figure 9:
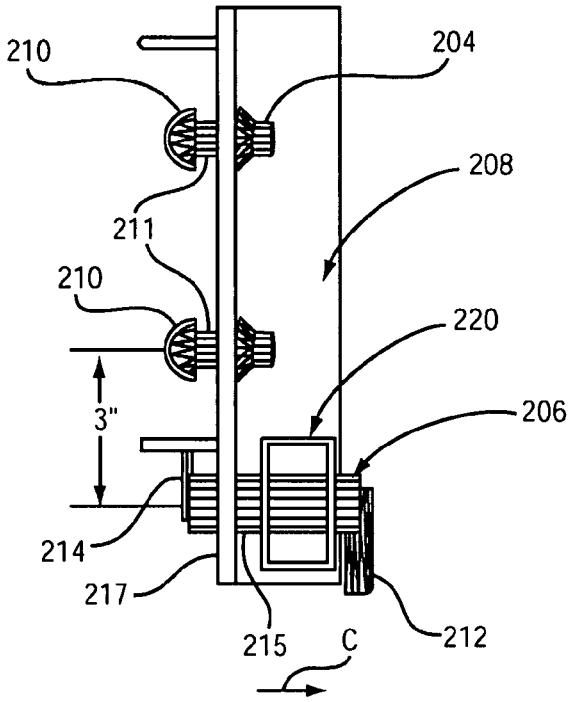
FIG. 9 is a front view of the beam of FIG. 8.

Referring to FIGS. 8 and 9, further details of an end portion of a beam 202 are illustratively shown. Flange 208 includes two studs 204 spaced in accordance with the openings 112 (FIG. 5). In one embodiment, the spacing includes about 4". Studs 204 each include a head 210. The head 210 prevents the studs 204 from being released from openings 112 when a stud shaft 211 is secured in second portion 114 of openings 112. At a corresponding spaced location, in this embodiment, 3" from the nearest stud 204, a retaining pin or keyed shaft 206 is employed to prevent the disengagement of the beam 202 from the module tower 100 (FIG. 5).

During assembly, retaining pin 206 is retracted in the direction of arrow "C" such that pin 206 sits flush or underflush with a surface 217. A key portion 214 should be turned such that it fits through second portion 114 when the beam 202 has been installed. Once studs 204 are secured in the second portion 114 of openings, pin 206 is advanced opposite to arrow "C" and turned to permit the engagement position as depicted in FIG. 7.

A handle 212 is provided on an opposite side of retaining pin 206 relative to the key portion 214. Handle 212 weighs more than the key portion 214. In this way, gravity assists in keeping shaft 215 from rotating to prevent release of the retaining pin 206. When the beam 202 is to be removed, the process is reversed. Retaining pin 206 is rotated and retracted and beam 202 is lifted and moved back from the joint to disassemble the connection. Friction and other forces may also be exploited to retain retaining pin 206 in its appropriate position during operation. It should be noted that in one embodiment, key portion 214 can be rotated to fit through flange 208 such that key portion fits through second opening 114 while the shaft 215 fits through the first opening 116.

Figure 10:
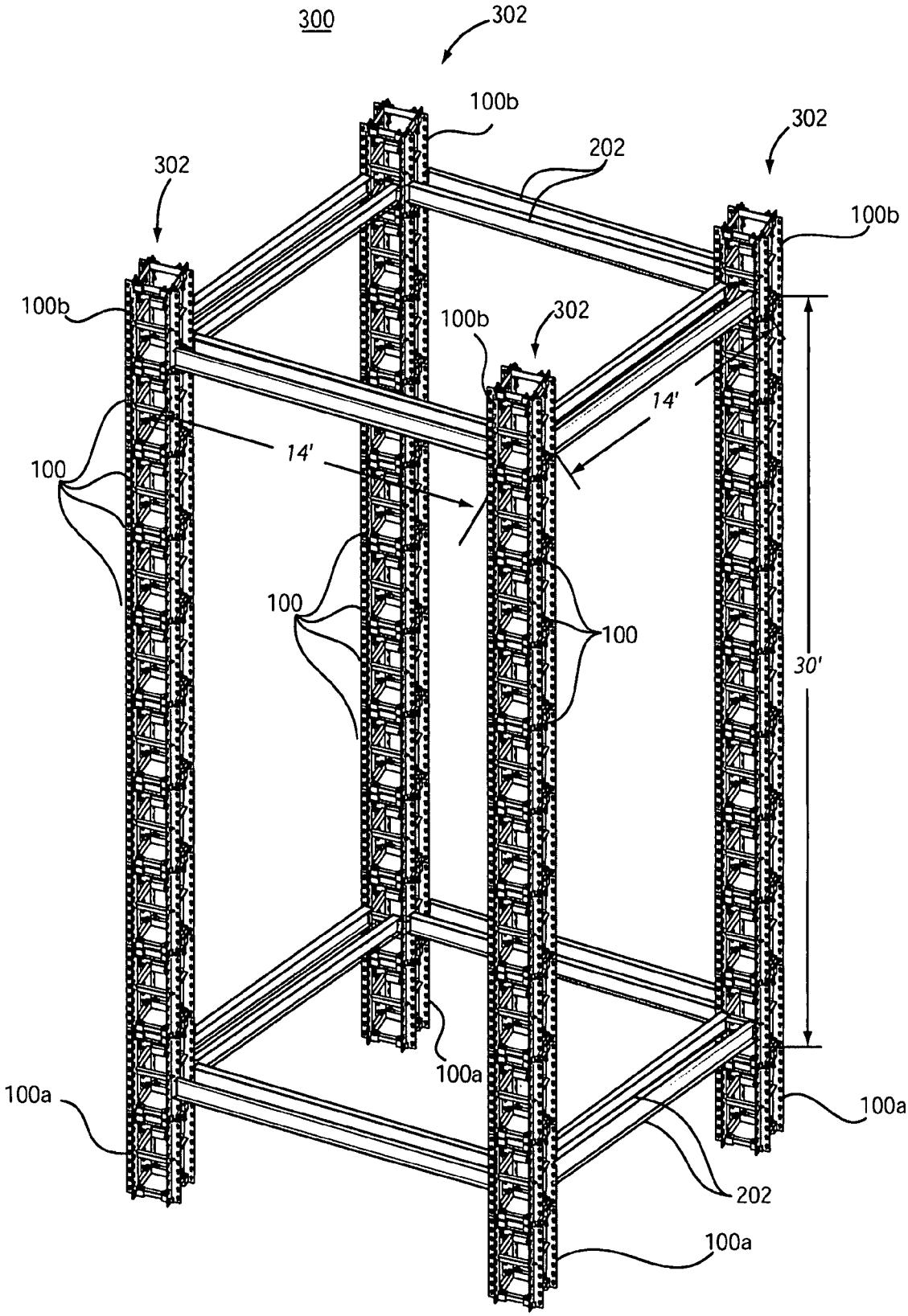
FIG. 10 is a perspective view of a platform constructed in accordance with one embodiment.

Referring to FIG. 10, a tower module structure 300 is shown in accordance with an illustrative embodiment. Structure 300 includes four tower module columns 302, which are in turn made up of a plurality of tower modules 100. Structure 300 may be free-standing or have portions anchored to walls or other structures. In one embodiment, a first set of tower modules **100*a* are placed on the ground or on the top of another structure. Beams 202 are secured to the tower modules 100*a* to form a rectangular structure, although any number of shapes may be formed including triangles, hexagons, octagons, etc. or other polygons as needed. To create structures where the beans meet at other than rights angles, then tower modules may be modified to permit angled connections. These angled connection modifications would only be needed for the tower modules that would receive beams. Alternately, the flanges 208 (FIG. 9) on beams 202** may be modified to provide different angular connections.

After the first tower modules **100*a* are set with beams 202, additional tower modules 100 are stacked and secured to form tower columns 302. Each tower module 100 is placed over a preceding one, lowered and aligned to the preceding tower module using pins 110 and features 121 (FIG. 2). Secured bolts 108 are employed for the preceding tower module 100 to bolt into nut plates 106 of the current tower module 100**.

In accordance with one embodiment, a span of 30 feet or more may be provided without the need for cross-bracing and before another set of beams 202 are to be employed. Each column forms a ladder-like structure, which can be climbed on by workers to assist in building the structure, or to escape in the event of a problem.

All of the systems in place today require the installation of temporary braces to create horizontal members or a place to support aluminum planks for construction or dismantle purposes only. In accordance with the present principles, column 302 uses tower modules 100 to present an open ladder-like construction on all four elevations which permits aluminum or other planks to be placed within any individual tower module 100 instantly creating a work platform for construction or dismantling.

In the embodiment shown in FIG. 10, after ten tower modules 100 another set of beams 202 are employed. This structure 300 may be repeated to provide greater height. The structure 300 is very stable and provides a wide stance (e.g., 14 feet per side). Other dimensions and configurations are also contemplated.

In addition, the ladder-like structure permits for planking to be installed through each tower module 100. Since each tower module 100 includes horizontal and vertical members in its structure, no diagonal support members are used. In this way, diagonal members do not interfere with laying a plank through a tower module 100.

Tower modules 100 are preferably put in place using a crane or similar device; however, the modules 100 are preferably sized to permit movement by one man and lifting by two men. E.g., each module is 150 pounds or less. Each tower module 100 is sized to permit easy transportation on a flat bed truck or even in a trailer for tractor trailer transport. Tower modules 100 may be stacked vertically or laid down horizontally for shipment or storage. The rectangular shape lends itself well to compact storage and shipment.

The structure 300 can be easily and quickly set up for a number of applications. These applications may include scaffolding, complementary structures, bridges, temporary or permanent buildings, temporary construction supports, sidewalk bridges/canopies, etc.

In one embodiment, the upper most tower modules 100*b* are configured to be secured to a top plate or plates (not shown) to form an elevated platform. The platform may be configured to receive the bolts (108) of the tower modules 100*b*.

Figure 11:
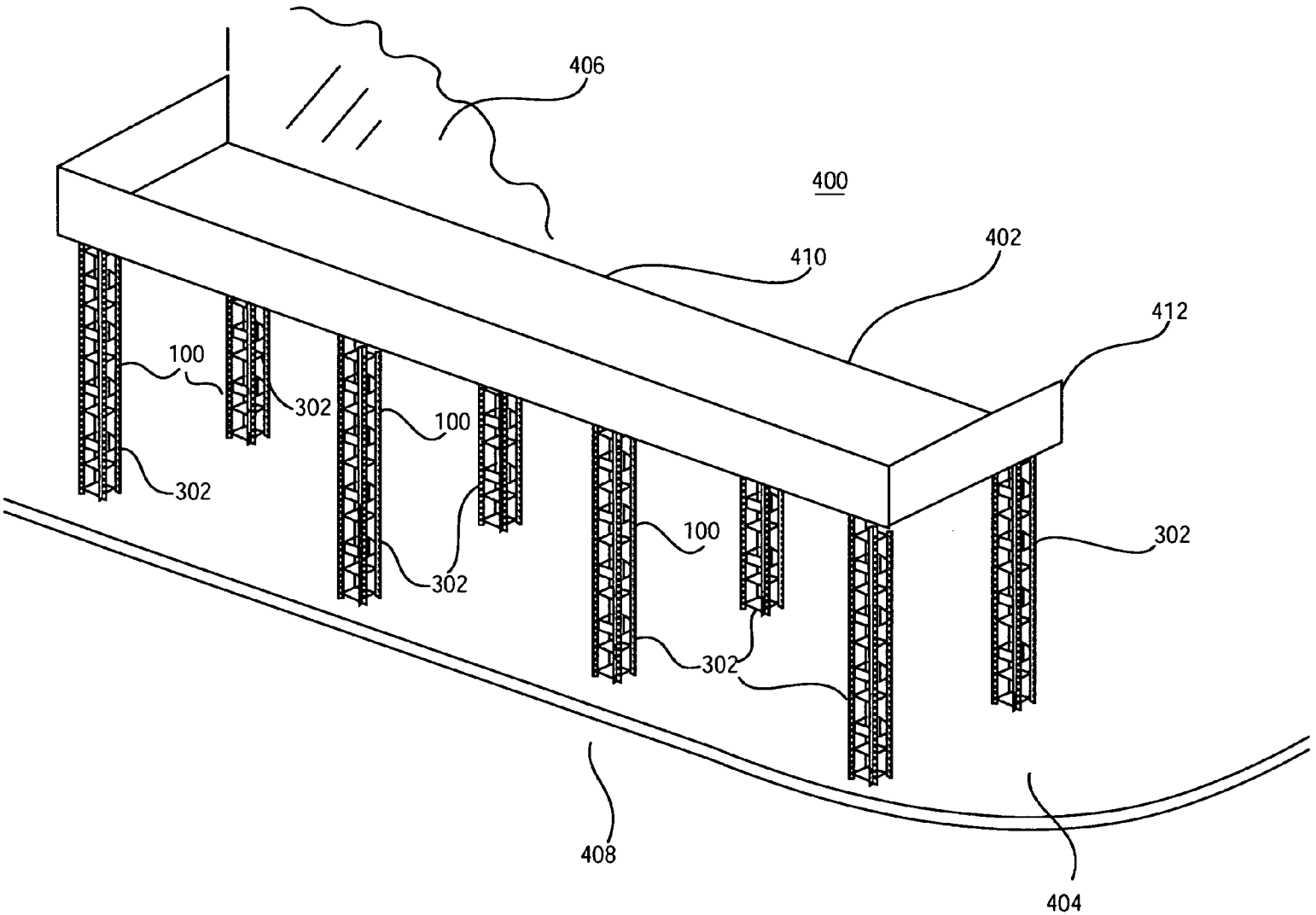
FIG. 11 is a perspective view of a sidewalk bridge constructed in accordance with one embodiment.

Referring to FIG. 11, a sidewalk bridge or canopy structure 400 is illustratively depicted which employs tower module columns 302 for support. Columns 302 are placed directly on a sidewalk 404, roadway 408 or other place where foot or vehicle traffic passes underneath. The structure 400 is preferably placed against a building 406 or other structure where work is being performed. Structure 400 protects passersby and vehicles from objects or debris that may fall as a result of work being performed or decay of a structure, by providing a platform 410 and preferably a wall 412. The flexible configuration of the structure 400 may include beams 202 (not shown) and can provide an easy and quick way of establishing a canopy structure 400 that is more aesthetic, more stable and stronger than existing solutions.

In addition, structure 400 may be employed as a complementary structure over a portion of a building or other obstacle to provide a platform or staging point for workers and materials to be transported from a hoist to a portion of a building, e.g., an upper floor being renovated or constructed.

Figure 12:
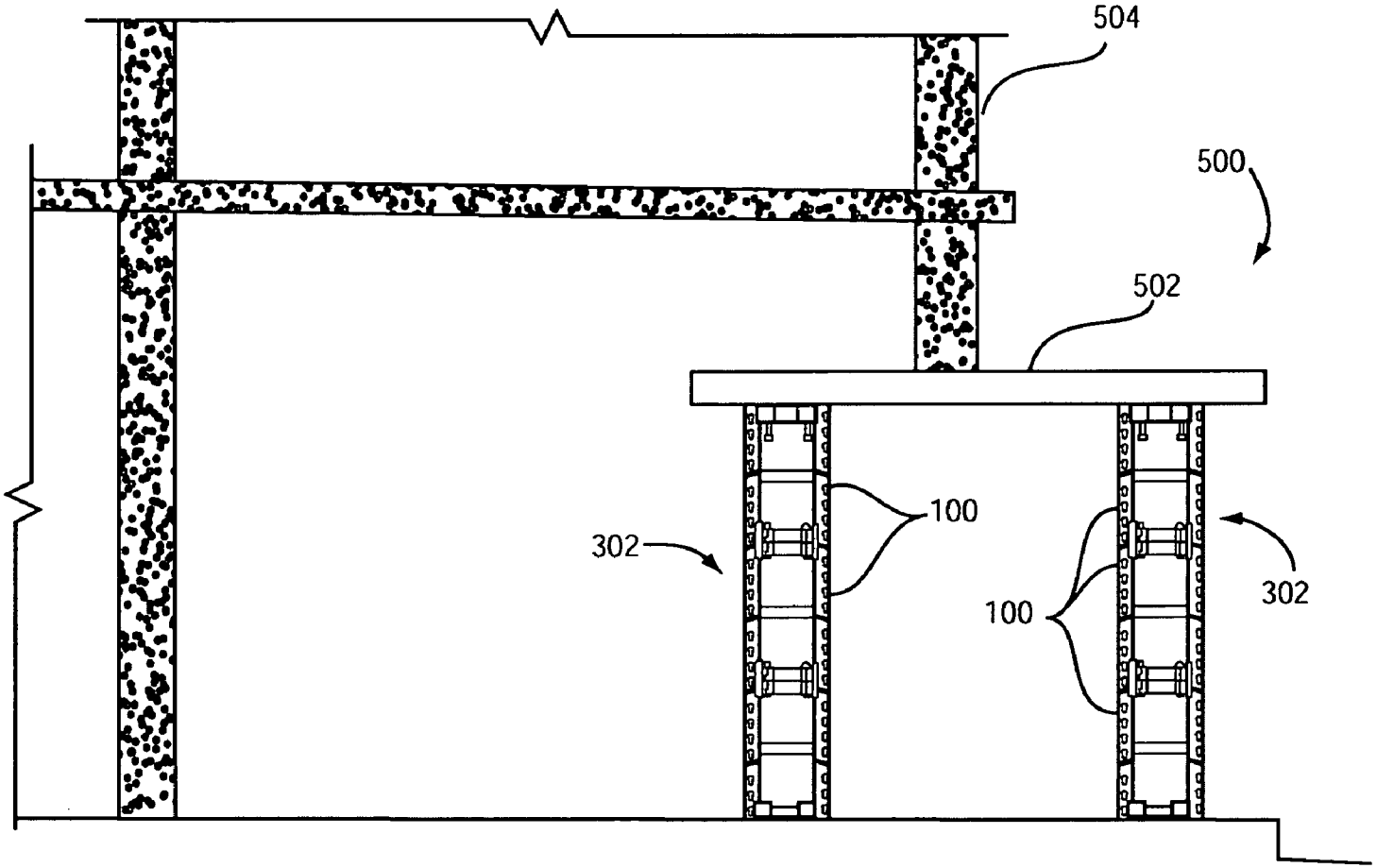
FIG. 12 is a perspective view of a shoring constructed in accordance with one embodiment.

Referring to FIG. 12, a shoring structure 500 is shown in accordance with another illustrative embodiment. Shoring 500 may include one or more towers 302 comprised of modules 100. Shoring 500 may be incorporated into a permanent or temporary structure 504 to provide support for the structure 504. Shoring 500 may include a beam or a plate 502 to provide support for a portion or an entire structure 504.

Figure 13:
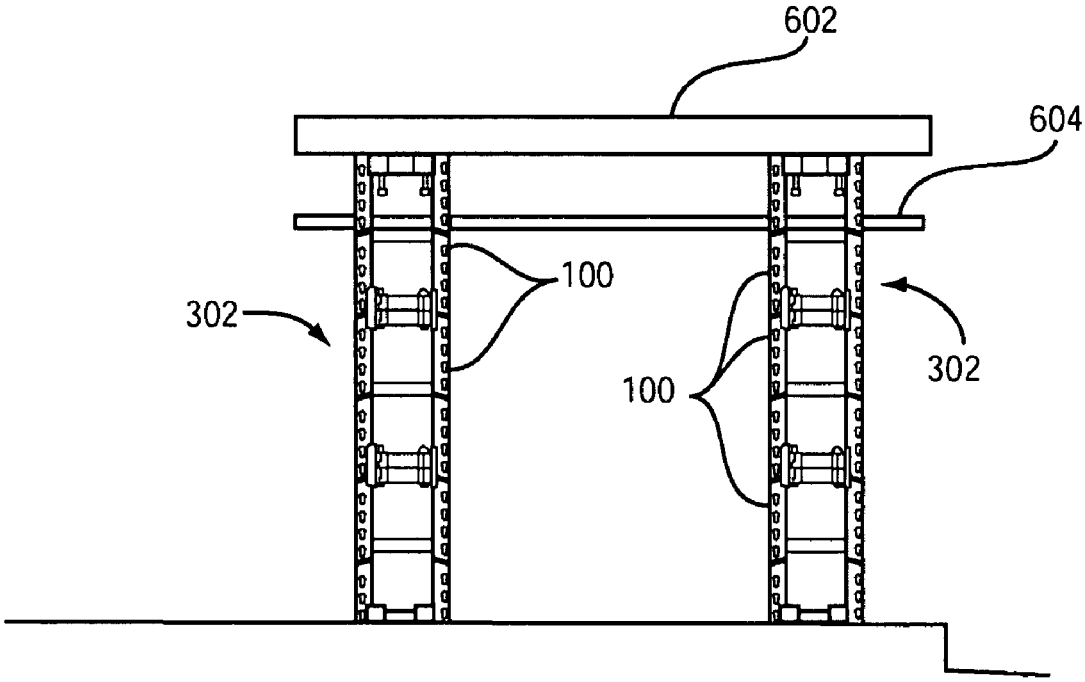
FIG. 13 is a perspective view of a platform and planking constructed in accordance with another embodiment.

Referring to FIG. 13, in other embodiments, tower modules 100 and columns 302 may be employed to provide a plurality of different working surfaces. As illustratively shown, a work platform 602 is depicted. Planking 604 may be employed through tower modules 100 to provide work surfaces, e.g., for scaffolds or the like.

In accordance with the present principles, the tower modules 100 and structures formed thereby provide many advantages over prior art systems. Some of these advantages include the following.

Local Moment Connection: Each tower module 100 is a self-contained unit with its rigidity being provided by moment connections between the horizontal (104) and vertical members (102) avoiding the need for sway braces and x-braces, which are commonly employed in this type of structure. This feature provides open space for aluminum picks or planks to be rested in during construction.

Global Moment Connection: Each tower module 100 is a self-contained structure when joined together, providing a tower modules column 302 of over 30' in height. This permits for a unit with no intermediate bracing other than top and bottom braces of the 30' span. Comparably, other systems require multiple braces and diagonals connected to each other to maintain stability.

Simplicity of Connection Points: Conventional systems in place today present tremendous fall hazards with numerous small parts and loose bolts. The tower module 100 and structures made thereof include a built-in flip-up or slide connecting bolt which is never removed from the tower module 100.

Connection of the Platform: Conventional systems typically require numerous nuts and bolts to connect the horizontal platforms to the vertical support members. The tower modules 100 and structures thereof provide a continuous keyhole arrangement on every elevation which receives a re-engineered platform beam with integral attachment pins which lock into place without any nuts or bolts.

Open Ladder-Like Construction: All of the systems in place today require the installation of temporary braces to create horizontal members to support aluminum planks for construction or dismantle purposes only. The tower module 100 and structures thereof present an open ladder-like construction on all four elevations which allows the aluminum planks to be placed within any individual tower module 100 instantly creating a work platform for construction or dismantling.

Having described preferred embodiments of a tower module platform system and method system and method (which are intended to be illustrative and not limiting), it is noted that modifications and variations can be made by persons skilled in the art in light of the above teachings. It is therefore to be understood that changes may be made in the particular embodiments disclosed which are within the scope and spirit of the invention as outlined by the appended claims. Having thus described aspects of the invention, with the details and particularity required by the patent laws, what is claimed and desired protected by Letters Patent is set forth in the appended claims.

What is claimed is:

1. A tower module for use in construction support structures, comprising:

at least two vertical support members wherein each vertical support member comprises two legs having outwardly extending distal end portions with respect to a central longitudinal axis of the tower module, the two legs forming an angle diverging from the central longitudinal axis of the tower module;

horizontal members rigidly attached between the vertical support members to provide a box structure free from diagonal members to permit planking members to be inserted and supported horizontally through the vertical support members for construction of a work platform, the box structure having a top end portion and a bottom end portion;

the top end portion including a first portion of a connection interface and the bottom end portion including a second portion of a connecting interface such that the top portion of a first tower module is adapted to receive and connect to the bottom portion of a second tower module for forming a column, wherein at least one of the top and bottom end portions comprise a built-in connection device comprising a built-in bolt is slidably connected to the connecting interface to connect respective tower modules such that no loose parts are available as a fall hazard, and the other of the top and bottom end portions includes a receiving portion for receiving said built-in bolt.

2. The tower module as recited in claim 1, wherein the second portion includes a threaded portion to receive the built-in bolt.

3. The tower module as recited in claim 1, wherein each connection interface includes at least four bolts.

4. The tower module as recited in claim 1, wherein the connection interface includes guide pins.

5. The tower module as recited in claim 4, wherein the guide pins are rigidly attached to the vertical members and assist in aligning the vertical members of one tower module to another.

6. The tower module as recited in claim 1, wherein the vertical members include a plurality of spaced openings configured to receive and secure studs of a structural member.

7. The tower module as recited in claim 6, wherein the plurality of spaced openings each includes a first opening portion configured to receive the stud and a second opening portion configured to secure the stud.

8. The tower module as recited in claim 1, wherein the horizontal members are connected to the vertical support members at a plurality of tiers.

9. The tower module as recited in claim 1, wherein the vertical support members each include an L-shaped cross-section.

10. The tower module as recited in claim 1, wherein a guide pin is located in the angle.

11. The tower module as recited in claim 1, wherein the vertical support members and the horizontal members form a ladder-like structure.

12. A tower module structure for use in construction support structures, comprising:

at least one tower module column, the tower module column including a plurality of stacked tower modules, the tower modules each including:

at lease two vertical support members wherein each vertical support member comprises two legs having outwardly extending distal end portions with respect to a central longitudinal axis of the tower module, the two legs forming an angle diverging from the central longitudinal axis of the tower module; and horizontal members rigidly attached between the vertical support members to provide a box structure free from diagonal members to permit planking members to be inserted and supported horizontally through the vertical support members for construction of a work platform, the box structure having a top end portion and a bottom end portion;

the top end portion including a first portion of a connection interface and the bottom end portion including a second portion of a connecting interface such that the top portion of a first tower module is adapted to receive and connect to the bottom portion of a second tower module for forming a column, wherein at least one of the top and bottom end portions comprise a built-in connection device comprising a built-in bolt is slidably connected to the connecting interface to connect respective tower modules such that no loose parts are available as a fall hazard, and the other of the top and bottom end portions includes a receiving portion for receiving said built-in bolt.

13. The tower module structure as recited in claim 12, wherein the second portion includes a threaded portion to receive the built-in bolt.

14. The tower module structure as recited in claim 12, wherein each connection interface includes at least four bolts.

15. The tower module structure as recited in claim 12, wherein the connection interface includes guide pins.

16. The tower module structure as recited in claim 15, wherein the guide pins are rigidly attached to the vertical members and assist is aligning the vertical members of one tower module to another.

17. The tower module structure as recited in claim 12, wherein the vertical members include a plurality of spaced openings configured to receive and secure studs of a structural member.

18. The tower module structure as recited in claim 17, wherein the plurality of spaced openings each includes a first opening portion configured to receive the stud and a second opening portion configured to secure the stud.

19. The tower module structure as recited in claim 18, wherein the structural member includes at least one beam such that gravity secures the beam using the studs in the second opening portion.

20. The tower module structure as recited in claim 19, further comprising a safety mechanism configured to prevent disassembly of the beam from the tower module.

21. The tower module structure as recited in claim 19, wherein the safety mechanism includes a keyed shaft that locks into position to prevent disassembly.

22. The tower module structure as recited in claim 12, wherein the horizontal members are connected to the vertical support members at a plurality of tiers.

23. The tower module structure as recited in claim 12, wherein the vertical support members each include an L-shaped cross-section.

24. The tower module structure as recited in claim 23, wherein a guide pin is located in the angle.

25. The tower module structure as recited in claim 12, wherein the vertical support members and the horizontal members form a ladder-like structure.

26. The tower module structure as recited in claim 12, wherein the plurality of stacked tower modules includes a span of at least thirty feet.

27. The tower module structure as recited in claim 12, wherein the tower module structure is included in at least one of a complementary structure, a sidewalk bridge, a shoring structure, and scaffolding.

28. The tower module structure as recited in claim 12, wherein the tower module structure is included in a building structure.

29. A method for assembling a tower module column, comprising:

providing a plurality of tower modules having; at least two vertical support members wherein each vertical support member comprises two legs having outwardly extending distal end portions with respect to a central longitudinal axis of the tower module, the two legs forming an angle diverging from the central longitudinal axis of the tower module, horizontal members rigidly attached between the vertical support members to provide a box structure free from diagonal members to permit planking members to be inserted and supported horizontally through the vertical support members for construction of a work platform, the box structure having a top end portion and a bottom end portion, the top end portion including a first portion of a connection interface and the bottom end portion including a second portion of a connecting interface such that the top portion of a first tower module is adapted to receive and connect to the bottom portion of a second tower module;

stacking the tower modules by engaging the top end portion of a first tower module with a bottom end portion of a second tower module in accordance with an alignment feature; and securing the top end portion to the bottom end portion using a built-in connection device to form a structural column, wherein at least one of the top and bottom end portions comprise the built-in connection device comprises a built-in bolt that is slidably connected to the connection interface to connect respective tower modules such that no loose parts are available as a fall hazard, and the other of the top and bottom end portions includes a receiving portion for receiving said built-in bolt.

30. The method as recited in claim 29, further comprising:

forming a plurality of columns; and connecting the plurality of columns using horizontal beams.

31. The method as recited in claim 29, wherein the vertical members include a plurality of spaced openings configured to receive and secure studs of the horizontal beams, the method further comprising:

inserting a stud into a first opening portion configured to receive the stud; and downwardly sliding the stud into a second opening portion configured to secure the stud.

32. The method as recited in claim 31, further comprising locking the horizontal beam using a keyed shaft.

33. The method as recited in claim 29, further comprising:

passing planking through the tower modules to create a working platform.

* * * * *